United States Patent [19]

Zulauf et al.

[11] Patent Number: 4,561,570

[45] Date of Patent: Dec. 31, 1985

[54] AUTOMATIC LOCKING DEVICE FOR A FLEXIBLE CONTAINER

[75] Inventors: Karlheinz Zulauf, Höchst-Hassenroth; Rudolf Egner, Pfungstadt, both of Fed. Rep. of Germany

[73] Assignee: Wella Aktiengesellschaft, Darmstadt, Fed. Rep. of Germany

[21] Appl. No.: 544,001

[22] Filed: Oct. 20, 1983

[30] Foreign Application Priority Data

Dec. 21, 1982 [DE] Fed. Rep. of Germany ... 8235857[U]

[51] Int. Cl.[4] ..... B67D 5/06

[52] U.S. Cl. ..... 222/153; 222/213; 222/494; 222/521

[58] Field of Search ..... 222/206, 212, 213, 215, 222/476, 481, 490–493, 495, 499, 521, 525, 545, 494, 502, 503, 519, 520, 153

[56] References Cited

U.S. PATENT DOCUMENTS

| | | | |
|---|---|---|---|
| 2,135,237 | 11/1938 | Lewis et al. | 222/520 |
| 2,750,084 | 6/1956 | Moran | 222/520 |
| 3,010,619 | 11/1961 | Gronemeyer et al. | 222/521 |
| 3,240,404 | 3/1966 | Porter et al. | 222/521 |
| 3,297,212 | 1/1967 | Neuner | 222/521 |
| 3,578,223 | 5/1971 | Armour | 222/521 |
| 3,608,793 | 9/1971 | VanLobenSels | 222/490 |
| 4,065,037 | 12/1977 | Haller | 222/153 |
| 4,432,496 | 2/1984 | Ito | 222/212 X |

FOREIGN PATENT DOCUMENTS

| | | | |
|---|---|---|---|
| 1318786 | 1/1963 | France | 222/491 |

OTHER PUBLICATIONS

PCT Application; Billy Nilson; Jan. 21, 1982, WO82/00128, Sweden.

*Primary Examiner*—Joseph J. Rolla
*Assistant Examiner*—Michael S. Huppert
*Attorney, Agent, or Firm*—Michael J. Striker

[57] ABSTRACT

A lock for a flexible bottle for containing a fluidic or pasty filler, such as skin cream or the like, includes a locking cap axially displaceable over the neck portion of the bottle and carrying a lip valve, and a sealing member mounted in the through passage of the neck portion. The lip valve has a lip-supporting ring-shaped portion extending into the sealing member and having two sealing surfaces cooperating with the sealing member upon the axial displacement of the locking cap with the lip valve relative to the neck portion of the bottle.

11 Claims, 7 Drawing Figures

16
7
15
III
8
9
10
17
6
23
22
11
2
25
12
3
26
5
II
II
4
1
III 22
3
20
6
1
15
21

AUTOMATIC LOCKING DEVICE FOR A FLEXIBLE CONTAINER

BACKGROUND OF THE INVENTION

The present invention relates to a resilient container for containing a fluidic or pasty medium, particularly a tubular container for accommodating skin cream, schampoo or the like. Even more particularly, this invention pertains to an automatic locking device of such a container.

Locking devices of flexible containers of the type under consideration include a locking hood or cap provided with a lip valve, and a sealing member between the end of the container, e.g. bottle, and the locking cap.

An automatic lock for a flexible container has been disclosed in the PCT application WO 82/00128; the disclosed lock comprises a diaphragm with a ring-shaped sealing lip which cooperates with a sealing member clipped on the through passage of the container. When the container is compressed by a hand of the user the filler contained in the container lifts the diaphragm and can thereby flow out outwardly of the container through the opening in the center of the diaphragm released from the sealing lip. If no pressure is exerted to the container then air will enter into the container through a valve in the sealing member so that the container takes its initial shape whereas the diaphragm of the locking hood will return to its closed position and the sealing lip will again lie against the sealing member. If the opening of the container is firmly closed the membrane is arrested in the closed position by rotation of the locking hood which is turnably positioned on the sealing member.

The known locking device has, however a complex construction and is complicated in handling. It is also costly in manufacturing of individual components and in assembly and requires an additional safety arrangement against an inadvertant rotation for the neck of the container connected to the sealing member.

SUMMARY OF THE INVENTION

It is an object of the invention to provide an improved locking device for a flexible container.

It is a further object of the invention to provide a locking device which is easy to assemble and to handle and which is not costly in manufacturing.

These and other objects of the invention are attained by an automatic locking device for a flexible container for accommodating a fluidic or pasty filler, particularly skin cream, shampoo or the like, and having a substantially cylindrical neck portion formed with a through passage, comprising a locking cap superimposing said through passage and having an opening; a lip valve of a resilient material mounted in said opening of the locking cap; and a sealing member positioned in said through passage and partially extended outwardly therefrom and cooperating with said lip valve for sealingly closing said through passage, said locking cap with said lip valve being displaceable relative to said neck portion in the direction of elongation thereof, said lip valve having a supporting portion extending into said sealing member and having a first sealing surface (16) at which said sealing member cooperates with said lip valve and a second sealing surface (12) arranged in contact with said sealing member.

The advantage of the container lock according to the invention is that it is very easy to handle and that the through passage of the container can be open easy and without many efforts. The insertion of the lip valve into the locking cap and the insertion of the sealing member into the through passage of the neck portion of the bottle requires no auxiliary means and can be carried out by hand and very fast.

Due to the simple constructions of the individual components of the lock it can be made of a synthetic plastic material by a spray-injection process which is inexpensive, which provides conditions for economical mass production.

The supporting portion of the lip valve may be ring-shaped and may have an outer peripheral side formed with a circular groove, said locking cap having an upper wall portion received in said circular groove and forming said opening.

The first sealing surface may be formed on the inner side of the supporting portion of the lip valve and may be either cylindrical or conical.

The sealing member may be formed with an annular cutout, said supporting portion including a sealing sleeve-like projection extending into said cutout and formed with said second sealing surface.

The sealing member may have a bottom wall forming said cutout, said bottom wall having through openings for passing therethrough said filler towards the lip valve.

The sealing member may be sealingly positioned in said through passage and has an outer peripheral wall formed with an annular bead which forms a limiting surface for the edge of said through passage.

The neck portion of the container having a free end formed with an annular bead, said locking cap having an inner surface formed with another annular bead cooperating with the annular bead on the end of the neck portion to form a snap-like connection therebetween.

The neck portion may have an outer thread and said locking cap has an inner thread cooperating with the outer thread, whereby upon rotation of said locking cap, said cap with said lip valve is displaced relative to said neck portion in the direction of elongation thereof and a passage for the filler is formed between said sealing member and said first sealing surface.

According to a modified embodiment of the invention the locking cap may have an inner surface formed with a circular rib, said neck portion having an outer surface, said rib sealingly abutting against said outer surface so that the displacement of said cap with said lip valve relative to said neck portion in the direction of elongation thereof is possible and upon said displacement a passage for the filler is formed between said sealing member and said first sealing surface.

The lip valve may further include two opposing lips and a slot, said lips releasing said slot for passing the filler therethrough upon application of pressure to said container and when said passage is formed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
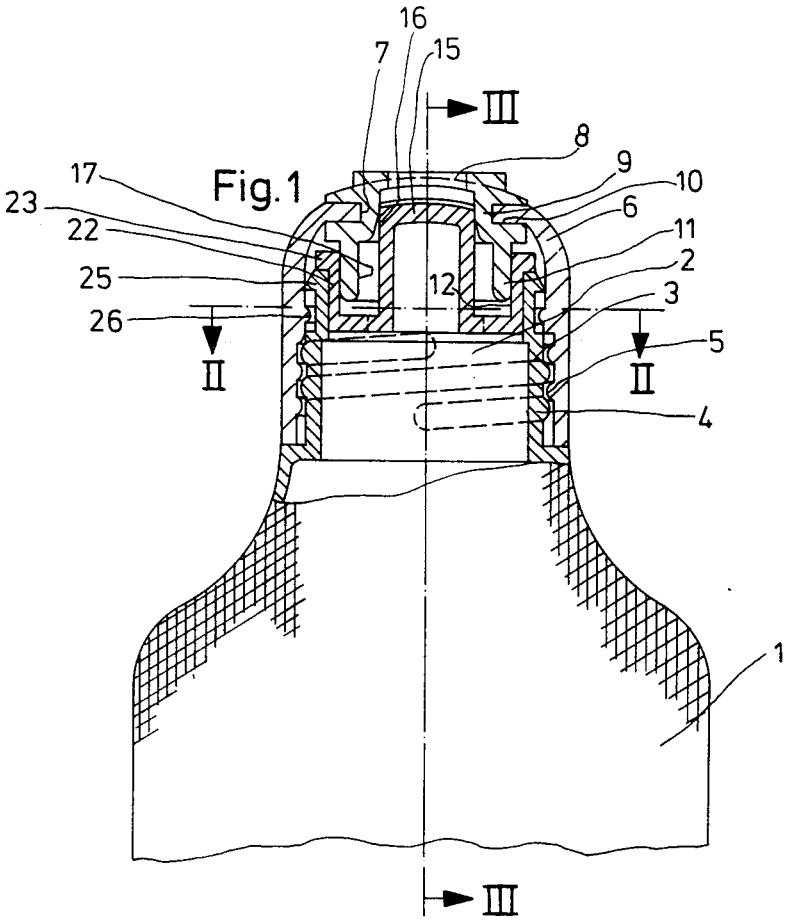
FIG. 1 is an axial sectional view of the locking device in a closed position, together with the upper portion of the bottle.
Figure 2:
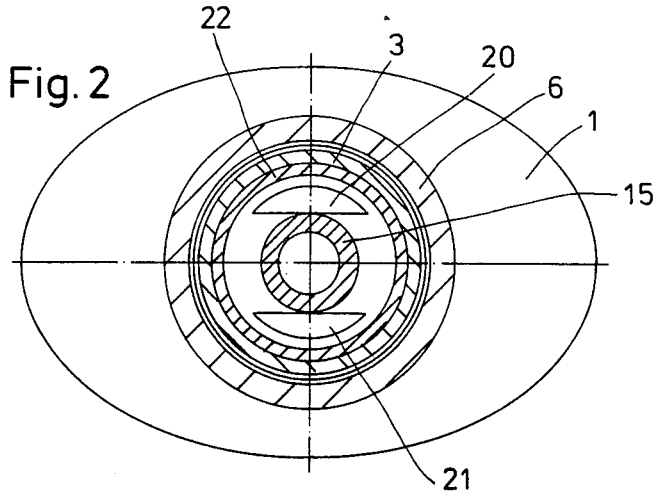
FIG. 2 is a sectional view along line II—II of FIG. 1.

Referring now to the drawings, and firstly to FIGS. 1 and 2 thereof, a reference numeral 1 designates a bottle of a synthetic plastic material, which can be filled with any suitable fluidic or pasty filler, such as shampoo, skin cream or the like. Bottle 1 has at the upper end thereof a neck or collar 3 formed with a central through passage 2. Collar 3 has an outer thread denoted by reference character 4. A locking cap 6 having an inner thread 5 is mounted by means of this thread on thread 4 of locking cap 6. The locking cap has a central opening 7 in which a supporting portion 9 of a lip valve 8 is tightly received. Supporting portion 9 has a circular groove 10 which receives the inwardly projecting walls of cap 6, forming the opening 7.

The lip valve 8 can be manufactured of a synthetic plastic material, rubber or any other suitable resilient material so that it can be easily inserted into opening 7 of the locking cap 6. Supporting portion 9 has a sealing sleeve-like flange or projection 11 extending downwardly toward the bottle and having a sealing surface 12 cooperating with a sealing member 15. The sleeve-like projection 11 is joined together with the locking cap 6 at the bottle collar 3 and prevents the penetration of the fille between the threads 4 and 5.

Figure 3:
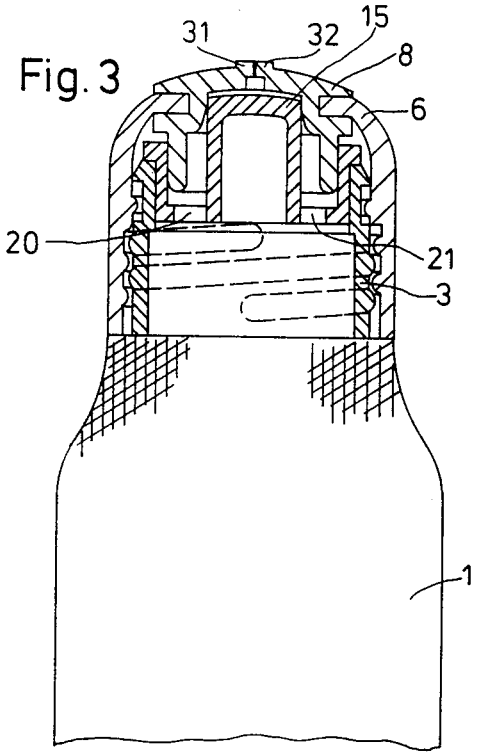
FIG. 3 is a sectional view along line III—III of FIG. 1.
Figure 4:
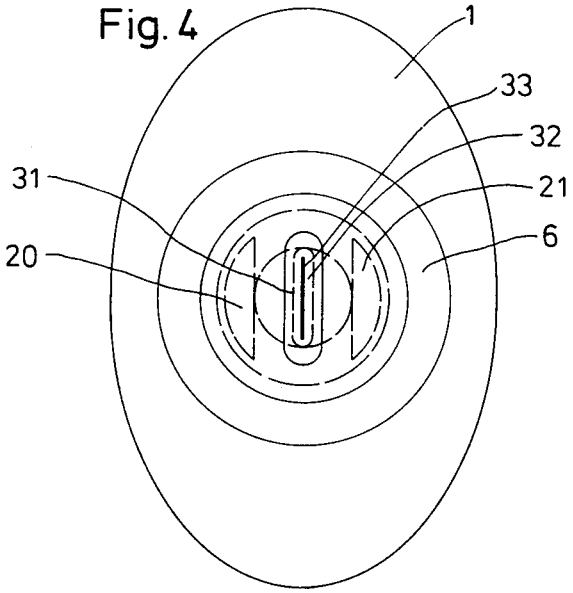
FIG. 4 is a top plan view of the bottle shown in FIG. 3.

A sealing member 15 is inserted into the through passage 2 of collar 3. Sealing member 15 cooperates with a substantially conical sealing surface 16 provided on the inner wall of supporting portion 9 of valve 8 so that in the closed position of the locking cap 6 shown in FIGS. 1 and 3, the filler is prevented from flowing out from the bottle even when pressure is exerted to the bottle 1, for example during the transportation of the bottle. The sealing member 15, which has a plug-like or trunnion-like shape, is formed with an annular cutout 17. The sleeve-like projection 11 of valve 8 is sealingly engaged in cutout 17 so that no filler can flow into the thread 4 in the bottle collar 3. The sealing member 15 has a bottom wall forming cutout 17, in which wall two through openings 20 and 21 for passing the filler therethrough are provided. Sealing member 15 has an outer peripheral wall 22 which sealingly lies against the inner wall of collar 3 of the bottle. The outer wall 22 of the sealing member has a ring-like flange 23 which forms a limiting surface for the border of through passage 2. A ring-shaped bead 25, which has a sloped outer surface, is provided on the free end of collar 3. Bead 25 cooperates with a ring-shaped bead 26 formed on the inner side of the locking cap 6 to form a snap connection so that after the locking cap has been screwed onto the bottle 1 a considerably great force should be applied onto the cap to screw it out or pull it from the bottle collar 3.

In the closed position of locking cap 6, shown in FIG. 1 the cylindrical inner portion of sealing member 15 extends into the supporting portion 9 of valve 8 and abuts against the sealing surface 16 of the supporting portion 9. Then no filler can flow out from the lip valve 8 even if a great deal of pressure is applied to the bottle which may be the case during the transportation of the filled bottles.

Figure 5:
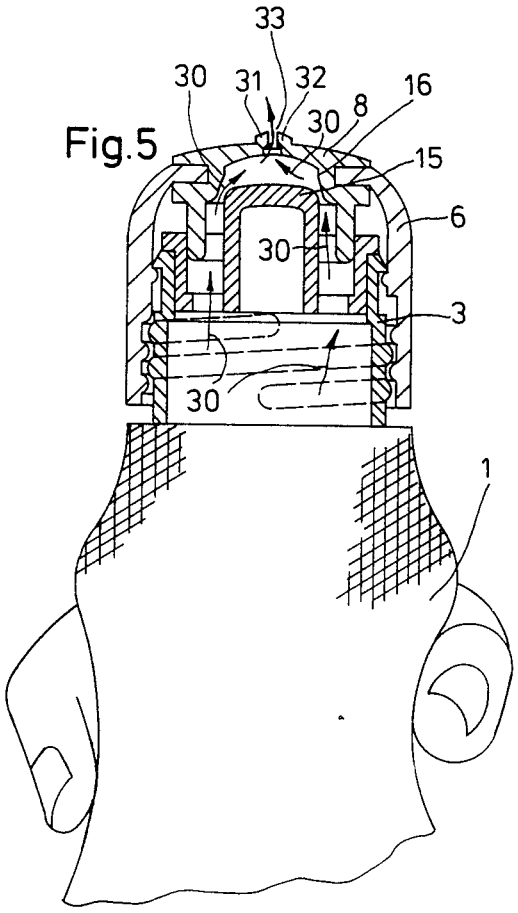
FIG. 5 is an axial sectional view of the locking device in an open position, together with a portion of the bottle pressed by fingers of a user.
Figure 6:
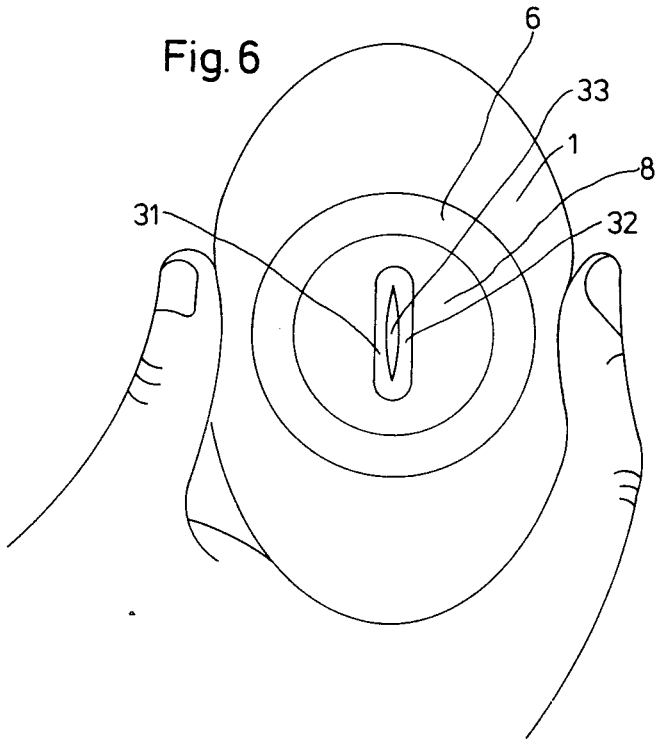
FIG. 6 is a top plan view of the bottle shown in FIG. 5.

With reference to FIG. 5 it will be seen that if the locking cap 6 is turned and lifted from the bottle 1 then the sealing member 15 will free the way for the filler as shown by arrows 30. If pressure is applied to the bottle by the fingers of the user the filler flows through openings 20, 21 and then outward through a slot 33 formed between two lips 31 and 32 because the pressure exerted by the filler will move two lips 31 and 32 apart from each other to open slot 33 as can be seen in FIG. 6. When no more pressure is applied to the bottle 1, an underpressure created in the bottle will be compensated for by outer air flowing in through slot 33 and when air pressure compensation is obtained lips 31, 32 will move towards each other and close slot 33 and the bottle will take its initial position. Lips 31 and 32 therefore form an automatically opening and closing lock whereas the locking cap 6 remains in the position of FIG. 5 and should not be turned further. A reverse rotation of the locking cap 6 into the position shown in FIG. 1 is necessary only in the event when the bottle 1 is not in use for a long period of time or if it should be transported to a remote site of location. For a complete emptying of the bottle or for refilling of the bottle the locking cap 6 as well as the sealing member 15 are removed from the collar 3.

Figure 7:
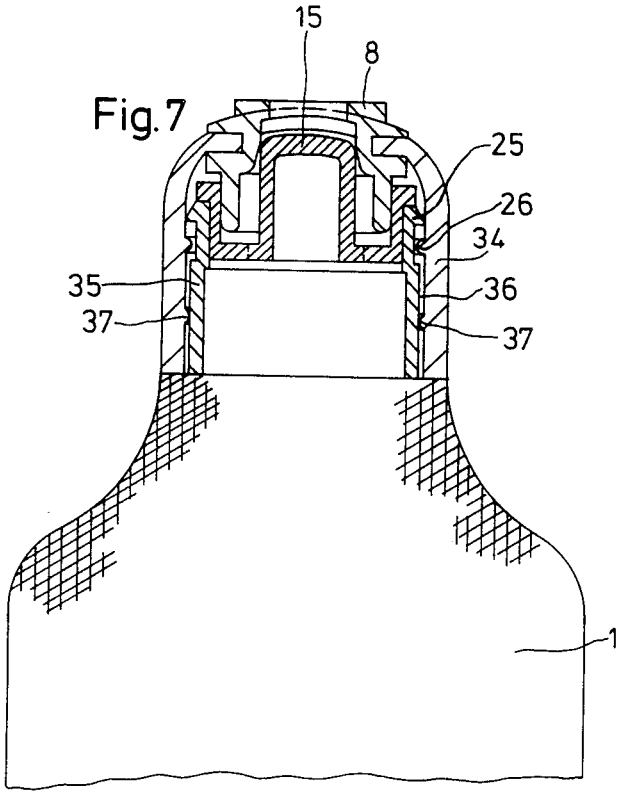
FIG. 7 is an axial sectional view of the locking device according to a modified embodiment of the invention.

In the embodiment shown in FIG. 7, a locking cap 34 adapted to move up and down along a collar 35 is provided. In this embodiment, in place of threads 4 and 5 formed on the collar and in the cap, a cylindrical outer surface of the bottle collar 35 cooperates with a circular rib 37 formed on the inner side of the locking cap 34. Due to this cooperation, locking cap 34 is guided by means of rib 37 over the outer peripheral surface 36 of collar 35 in the axial displacement relative thereto.

It will be understood that each of the elements described above, or two or more together, may also find a useful application in other types of locking devices for flexible containers automatic differing from the types described above.

While the invention has been illustrated and described as embodied in an automatic locking device for a flexible container, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An automatic locking device for a flexible container for accommodating a fluidic or pasty filler, particularly skin cream, shampoo or the like, and having a substantially cylindrical neck portion formed with a through passage, comprising a locking cap superimposing said through passage and having an opening; a lip valve of a resilient material mounted in said opening of the locking cap; and a sealingg member positioned in said through passage and partially extended outwardly therefrom and cooperating with said lip valve for sealingly closing said through passage, said locking cap with said lip valve being displaceable relative to said neck portion in the direction of the elongation thereof, said lip valve including two opposing lips which release a slot therebetween for passing the filler therethrough upon application of pressure to said container and sealingly close said slot when said pressure is released, said lip valve further having a supporting portion having a firstt sealing surface (16) at which said sealing member cooperates with said lip valve and a second sealing surface (12) arranged in contact with said sealing member.

2. The device as defined in claim 1, wherein said supporting portion is ring-shaped and has an outer peripheral side formed with a circular groove, said locking cap having an upper wall portion received in said circular groove and forming said opening.

3. The device as defined in claim 2, wherein said supporting portion has an inner side formed with said first sealing surface.

4. The device as defined in claim 3, wherein said first sealing surface is cylindrical.

5. The device as defined in claim 3, wherein said first sealing surface is conical.

6. The device as defined in claim 5, wherein said sealing member is formed with an annular cutout, said supporting portion including a sealing sleeve-like projection extending into said cutout and formed with said second sealing surface.

7. The device as defined in claim 6, wherein said sealing member has a bottom wall forming a base of said cutout, said bottom wall having through openings for passing therethrough said filler towards said lip valve.

8. The device as defined in claim 7, wherein said sealing member is sealingly positioned in said through passage and has an outer peripheral wall formed with an annular bead which forms a limiting surface for the edge of said through passage.

9. The device as defined in claim 8, said neck portion of the container having a free end formed with an annular bead, said locking cap having an inner surface formed with another annular bead cooperating with the annular bead on the end of the neck portion to form a snap-like connection therebetween.

10. The device as defined in claim 1, wherein said neck portion has an outer thread and said locking cap has an inner thread cooperating with said outer thread whereby upon rotation of said locking cap, said cap with said lip valve is displaced relative to said neck portion in the direction of elongation thereof and a passage for the filler is formed between said sealing member and said first sealing surface, said lips releasing said slot only when said passage is formed.

11. The device as defined in claim 1, wherein said locking cap has an inner surface formed with a circular rib, said neck portion having an outer surface, said rib sealingly abutting against said outer surface so that the displacement of said cap with said lip valve relative to said neck portion in the direction of elongation thereof is possible and upon said displacement a passage for the filler is formed between said sealing member and said first sealing surface, said lips releasing said slot when said passage is formed.

* * * * *